United States Patent [19]

Munroe

[11] 4,214,135

[45] Jul. 22, 1980

[54] BOTTOM TURN SOCKET

[75] Inventor: Ronald G. Munroe, Georgetown, S.C.

[73] Assignee: Eagle Electric Mfg. Co., Inc., Long Island City, N.Y.

[21] Appl. No.: 955,986

[22] Filed: Oct. 30, 1978

[51] Int. Cl.[2] ..... H01R 33/28; H01R 13/58

[52] U.S. Cl. ..... 200/51.17; 339/103 M; 200/51.14

[58] Field of Search ..... 200/51.14, 51.17, 299, 200/51.15, 51.16, 303; 339/105, 103 R, 103 M; 174/135

[56] References Cited

U.S. PATENT DOCUMENTS

| | | | |
|---|---|---|---|
| 2,101,680 | 12/1937 | Johnson | 200/51.17 |
| 2,483,120 | 9/1949 | Benander | 200/51.17 |
| 2,526,325 | 10/1950 | Burtt | 339/103 M X |
| 2,612,570 | 9/1952 | Patrick | 200/51.16 |
| 3,013,130 | 12/1961 | Brosius | 200/51.16 |

*Primary Examiner*—Steven M. Pollard
*Attorney, Agent, or Firm*—Kirschstein, Kirschstein, Ottinger & Cobrin

[57] ABSTRACT

A socket mountable in a light fixture such as a table or floor lamp or a wall fixture. An electric light bulb is mounted in the socket, and is switched off and on by means of a central lower axial switch, the turn knob of the switch depending downwards from the socket. The improved bottom turn socket features a husk and cooperating lower cover housing about the switch. The housing includes at least one interior boss. The electric line cord is placed in a slot in the cover housing, and the boss, which is adjacent the slot, pinches the line cord against an end of the husk when the cover housing is emplaced, to provide strain relief. Preferably, two slots are provided in the cover housing, each having an associated adjacent interior boss to provide strain relief, so that a second line cord electrically connected in parallel within the bottom turn socket may extend from the husk of the socket to another light fixture.

6 Claims, 6 Drawing Figures

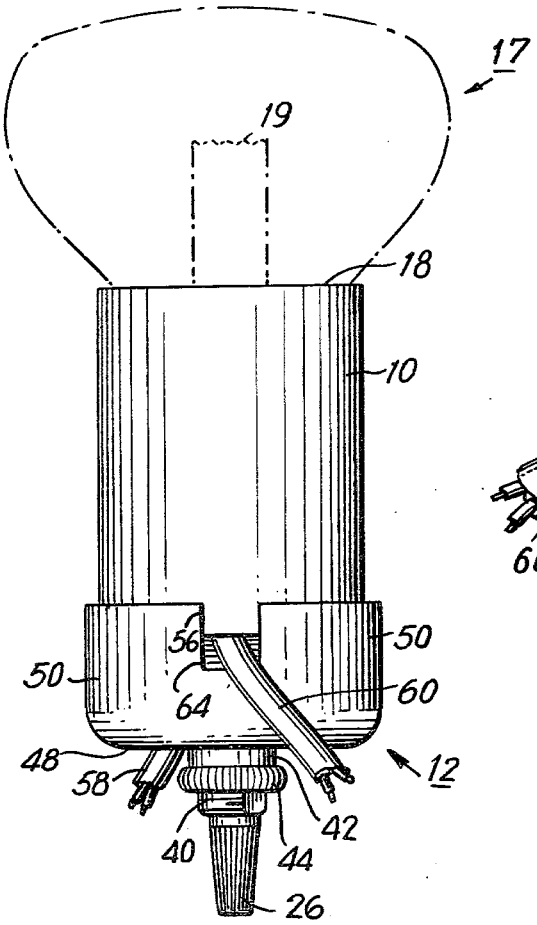
FIG. 4
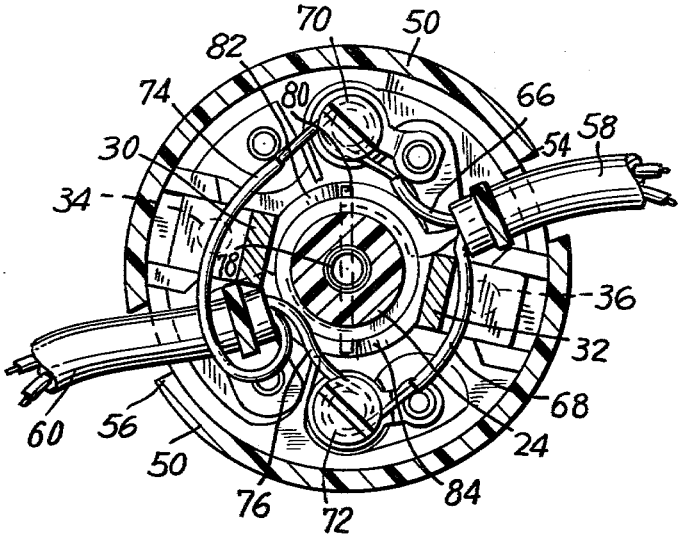
FIG. 5
FIG. 6
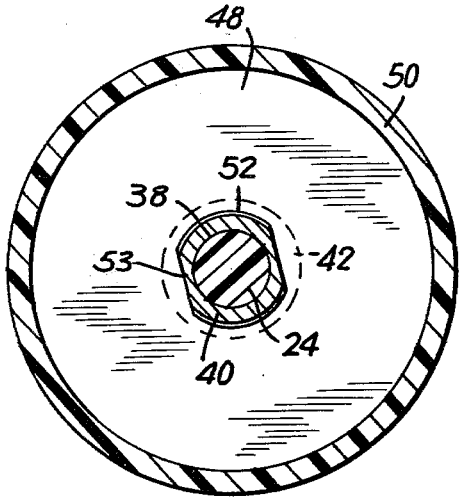

BOTTOM TURN SOCKET

BACKGROUND OF THE INVENTION

1. Field of the Invention

A bottom turn socket.

2. Description of the Prior Art

Bottom turn sockets are electrical sockets for a light bulb or the like, in which a central axial stem extends from the cylindrical body or husk and terminates with a turn knob for switching the light bulb on and off. Bottom turn sockets are used on color wheels, decorations, bed lamps, pin-up lamps, wall fixtures, table or floor lamps, and wherever the socket is exposed. Bottom turn sockets may have a dimmer control, an on-off switch, a removable knob, a double control, etc. Bottom turn sockets per se, usually with bakelite husks, are well known commercial items. With the prior art style devices, it is necessary to thread the line cord through the slot in the outer plastic husk, tie a strain relief knot, and make the terminations through the socket interior before completing the assembly. Strain relief means that when the electrical cord going to the socket is pulled or tugged, an anchoring means in the fixture of some sort is provided, such as the strain relief knot mentioned supra, which acts against the cord so that the force of the tugging or pulling of the cord cannot extend against the electrical connection, and ends short of the electrical connection, i.e., the force is exerted through the cord against the fixture per se rather than against the electrical junctions or terminals within the fixture. Pertinent prior art relative to electric light bulb sockets includes U.S. Pat. Nos. 698,218; 741,924; 962,589; 1,849,846; 3,013,130; 3,072,878; 3,369,214; 3,609,645; 3,805,211; 3,910,674.

SUMMARY OF THE INVENTION

1. Purposes of the Invention

It is an object of the present invention to provide an improved bottom turn socket.

Another object is to provide a bottom turn socket with an external husk having a separate lower cover housing.

A further object is to provide a bottom turn socket having an improved structural configuration for strain relief.

An additional object is to provide a bottom turn socket with integral strain relief.

Still another object is to provide a bottom turn socket having a separate cover housing with integral interior bosses which bear down on the line cord wires to provide strain relief.

Still a further object is to provide a bottom turn socket with separate cover housing which insulates the wiring terminals as well as providing strain relief.

Still an additional object is to provide a bottom turn socket which is a less expensive product to produce than prior art bottom turn sockets.

An object is to provide a bottom turn socket which has engineering advantages over present sockets on the market.

An object is to provide a bottom turn socket which can be sold at a considerably lower cost than older devices.

An object is to provide a bottom turn socket which provides a definite labor savings to the manufacturer who is using the socket in the fabrication and assembly of any or all of the light fixtures, lamps, etc. mentioned supra.

An object is to provide a bottom turn socket in which it is only necessary to make the terminal wiring connections and complete the assembly of the insulation outer cover housing.

An object is to provide a bottom turn socket in which a strain relief is automatically provided by means of interior bosses in the cover housing which bear down on the line cord wires when the assembly nut is tightened.

These and other objects and advantages of the present invention will become evident from the description which follows.

2. Brief Description of the Invention

In the present invention, the concept of providing a separate cover housing on a bottom turn socket is contemplated. The new separate bottom cover housing is preferably composed of bakelite, as is the husk of the bottom turn socket. The present cover housing has one, or preferably two, lateral slots or openings, and interior bosses which bear down on the line cord wires to provide strain relief. The bakelite cover housing insulates the wiring terminals as well as providing strain relief. In the present invention, it is only necessary to make the electrical termination and complete the assembly of the insulation outer cover housing. When this is done, a strain relief is automatically provided by means of interior bosses in the cover housing, which bear down on the line cord wires when the assembly nut is tightened. In a preferred embodiment, there are two exit slots in the cover housing. The second slot is to provide both strain relief and an exit for a second line cord which would parallel the power connections to a second fixture socket.

In accordance with the present invention, the present bottom turn socket basically entails the provision of a generally cup-shaped cover housing including a crown and a skirt. The crown has a central opening through which the stem of the switch is extended. Means is provided to detachably mount the cover housing to an end of the husk of the socket. Thus, the cover housing covers the end of the husk, and the skirt is telescoped over this end of the husk. The cover housing has at least one peripheral slot in its skirt into which an electrical line cord is placed. The cover housing also includes at least one interior boss adjacent the slot, which boss pinches the line cord against the husk when the cover housing is emplaced, thus providing strain relief.

The present bottom turn socket also basically includes the husk, means at one end of the husk for receiving the threaded base of a light bulb, means within the husk for supplying electric power to the light bulb via its threaded base, and means within the husk for selectively interrupting the flow of electric power to the light bulb, which preferably includes a switch, the switch including a central axial stem and means mounting the stem to the opposite end of the husk. The stem terminates with a manually operable turn knob. The switch is manipulated by partial rotation of the turn knob. Terminal means are provided at the opposite end of the husk for connection to the ends of the line cord, so as to furnish electric power to the light bulb mounted in the socket.

In a preferred embodiment, the switch includes a sleeve through which the stem extends, and the means mounting the cover housing to an end of the husk includes means movable axially of the sleeve to press against the cover housing. The sleeve is preferably externally threaded, in which case the means movable axially of the sleeve is a lock ring screwed onto the sleeve. Preferably the sleeve and the central opening in the crown, through which the sleeve extends, are of matching non-circular configurations.

The means mounting the stem to an end of the husk typically includes a two-leg bracket, the terminal end of each leg of the bracket being attached to the end of the husk. The bracket has an opening, generally a central opening, through which the stem extends.

As mentioned supra, the number of interior bosses and adjacent slots in the cover housing is preferably two, with the second boss pinching a second line cord in parallel electrical connection with the first line cord, the connection being made at terminals within the socket. The second line cord extends to a second fixture.

The present invention provides several salient advantages. The present improved bottom turn socket provides integral strain relief, via the separate lower cover housing with integral interior bosses which bear down on the line cord wire or wires to provide strain relief. The separate cover housing insulates the wiring terminals as well as providing strain relief. The present bottom turn socket is a less expensive product to produce than prior art bottom turn sockets, and has engineering advantages over present sockets on the market. Thus the present bottom turn socket can be sold at a considerably lower cost than older devices. The present socket provides a definite labor savings to the manufacturer who is using the socket in the fabrication and assembly of any or all types of light fixtures, lamps etc., since integral strain relief is provided which means that the line cord does not have to be tied. In other words, in the present socket it is only necessary to make the terminal wiring connections and complete the assembly of the insulation outer cover housing. Finally, the principal advantage of the present bottom turn socket is that strain relief is automatically provided by means of integral interior bosses in the cover housing, which bosses bear down on the line cord wire or wires when the socket assembly nut is tightened.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 4 is an elevation view of the side of the socket opposite to that of FIG. 2;

FIG. 5 is a bottom plan view taken substantially along the line 5—5 of FIG. 3; and FIG. 6 is a sectional view taken substantially along the line 6—6 of FIG. 3.

DETAILED DESCRIPTION OF THE PREFERRED EMBODIMENTS

Figure 1:
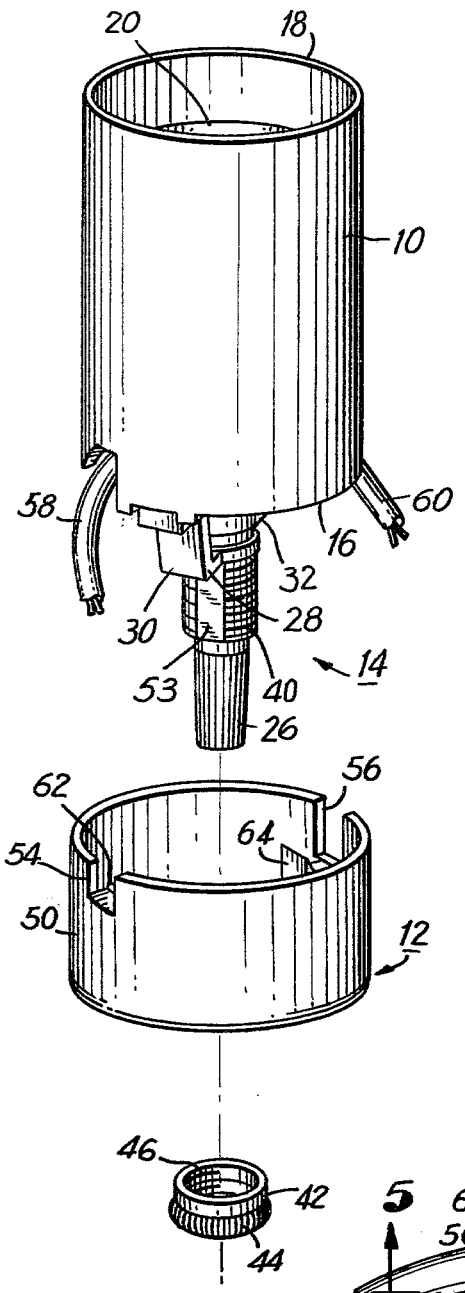
FIG. 1 is an exploded perspective view of the present bottom turn socket.
Figure 3:
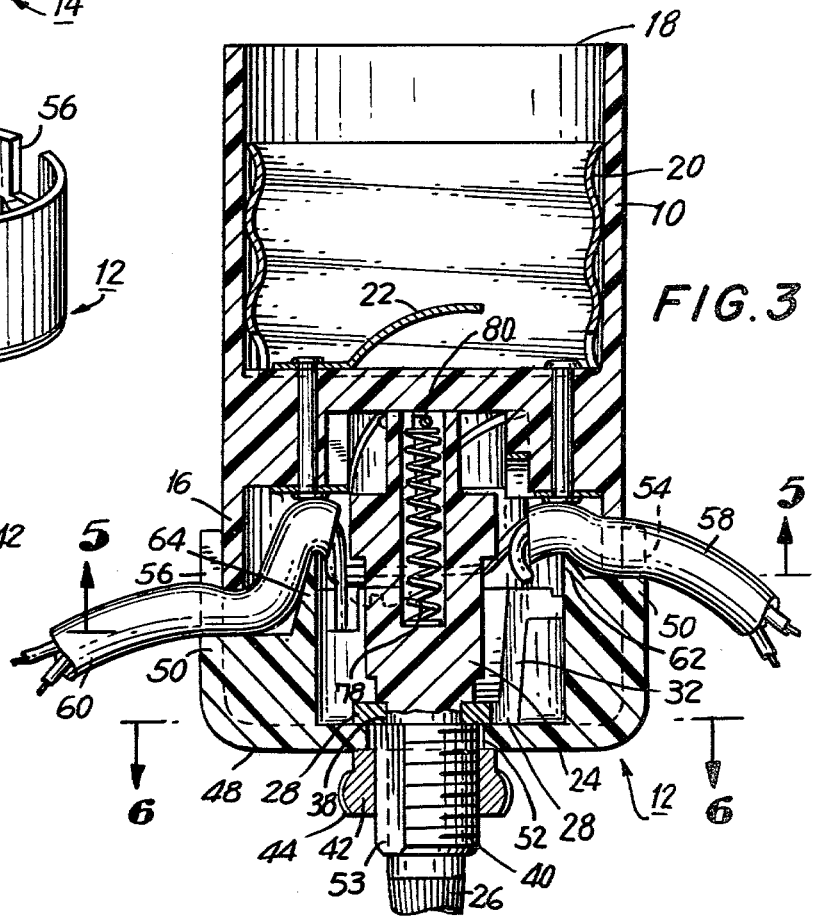
FIG. 3 is a sectional elevation view taken substantially along the line 3—3 of FIG. 2.

Referring now to FIG. 1, the present bottom turn socket includes a husk 10 and removable lower cover housing 12. A switch means generally designated as 14 is mounted to and depends downwards from an end 16 of the husk 10. An electric light bulb 17, shown in phantom outline (FIG. 4), is mountable in the other end 18 of the husk 10. The light bulb 17 is provided with an externally threaded base, which functions to conduct electricity to the filament 19 of the bulb 17 via an annular metallic threading, which contacts the generally cylindrical female threaded member 20 of the socket (FIG. 3). A bottom central metal contact on the base of the light bulb 17 contacts the resilient curved metal member 22 when the light bulb 17 is manipulated and screwed into the upper end 18 of the husk 10 and seated in the socket.

The bottom turn socket includes means within the husk 10 for selectively interrupting electric power flow to the light bulb 17. This means for interrupting electric power flow includes the switch 14. The switch 14 includes a central axial stem 24 which terminates with a manually operable turn knob 26; the switch 14 is manipulated by partial rotation of the turn knob 26. Means is provided for mounting the stem 24 to the end 16 of the husk 10. This mounting means typically includes a bracket 28 having two opposed dependent legs 30 and 32. The terminal end of each leg 30, 32 is attached to the end 16 of the husk 10, typically by respective riveted mounting attachments 34, 36 (FIG. 5). The bracket 28 has a central opening 38 through which the stem 24 extends from the socket husk 10 to the turn knob 26. The stem 24 typically extends through an externally threaded sleeve 40 which is an integral part of and depends centrally downwards from the bracket 28. The sleeve 40 extends coaxially from the central opening 38 of the bracket 28 and terminates just short of the turn knob 26 when the socket is assembled. As best seen in FIG. 6, the sleeve 40 is concentrically disposed externally to a portion of the stem 24 in practice, so that the stem 24 extends through the sleeve 40.

In this embodiment of the invention, the means provided for mounting the cover housing 12 to the end 16 of the husk 10 includes means movable axially of the sleeve, namely, a lock ring 42 having a knurled portion 44 and internal threading 46 (FIG. 1), which lock ring 42 is screwed onto the sleeve 40 to press against the cover housing 12.

Figure 2:
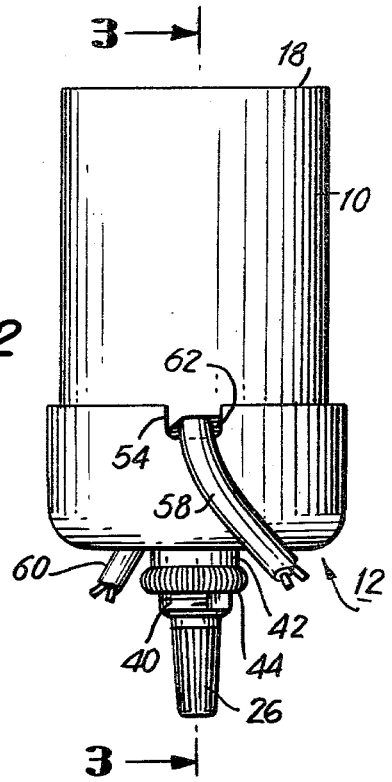
FIG. 2 is an elevation view of one side of the socket.

The cover housing 12 is of generally cup-shaped configuration, and the cover housing 12 generally includes a crown 48 and a skirt 50. The crown 48 has an opening 52 through which the stem 24 extends. As best seen in FIG. 6, the sleeve 40 and the opening 52 in the crown 48 are typically of matching non-circular configurations to prevent relative rotation; in this case, each of these elements is provided with opposed planar sections or flats such as the flat 53 on the sleeve 40 (FIGS. 1, 3 and 6). The lock ring 42, sleeve 40 and bracket 28 typically constitute means detachably mounting the cover housing 12 to the end 16 of the husk 10, so that the detachable cover housing 12 covers the end 16 of the husk 10 as best seen in FIGS. 2, 3 and 4, and so that the skirt 50 is telescoped over the end 16 of the husk 10.

In accordance with the present invention, the cover housing 12 has peripheral slots 54, 56 in the skirt 50, and respective line cords 58, 60 have each been placed in a respective slot 54 or 56. The cover housing 12 also has chisel-shaped interior bosses 62, 64, each of which is adjacent its respective slot 54, 56. When the socket is assembled, with the cover housing 12 emplaced, as best seen in FIG. 3, each interior boss 62 or 64 pinches its respective line cord 58 or 60 against the end 16 of the husk 10 to provide strain relief of the line cords 58, 60.

Terminal means are provided in the socket at the end 16 of the husk 10 for connection to the ends of the line cord 58, so as to furnish electric power to the light bulb 17. Referring now to FIG. 5, the ends 66, 68 of the line cord 58 are each connected to a respective electrical terminal 70, 72, and the terminals 70, 72 are electrically connected to the respective elements 20, 22 when the switch 14 is closed, so as to complete an electrical circuit through the filament 19 of the light bulb 17. The ends 74, 76 of the line cord 60 are also each connected to one of the respective electrical terminals 70, 72, so that the line cord 60 is electrically connected in parallel with the line cord 58 and thereby conducts electricity to a second fixture, not shown. It will be understood by those skilled in the art that the free end of the line cord 58 extends to a source of electrical power for both the light bulb 17 and the second fixture.

The switch 14 includes a central spring 78 which is coaxial with and mounted within the stem 24 and a transverse horizontal metal pin 80 which rotates about the central vertical axis of the spring 78 and stem 24 when the switch 14 is manipulated by partial rotation of the turn knob 26. The pin 80 alternately electrically connects or disconnects the metal camming surfaces 82, 84, to alternately complete or interrupt an electrical circuit within the switch 14, so as to alternately pass electric power to the light bulb filament 19 and cause illumination of the fixture in which the bottom turn socket is mounted, or to interrupt electric power flow to the filament 19 and terminate illumination of the fixture.

It thus will be seen that there is provided a bottom turn socket with integral strain relief via a new configuration of detachable lower cover housing which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawing is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A bottom turn socket comprising a husk, means at one end of said husk for receiving the threaded base of a light bulb, means within said husk for supplying electric power to said light bulb via said threaded base, means within said husk for selectively interrupting the flow of electric power flow to said light bulb, said means for interrupting electric power flow including a switch, said switch including a central axial stem, means mounting said stem to the other end of said husk, said other end of the husk having a centrally disposed bottom opening recess, said stem being located centrally of said recess, said stem terminating with a manually operable turn knob, said switch being manipulated by partial rotation of said turn knob, terminal means at the other end of said husk within said recess for connection to the ends of a line cord so as to furnish electric power to said light bulb, a generally cup-shaped cover housing including a crown and a skirt, said crown having an opening through which the stem extends, and means detachably mounting said cover housing to said other end of said husk, said cover housing covering the other end of said husk and said skirt being telescoped over said other end, said cover housing having at least one peripheral slot in its skirt in which said line cord is located, said cover housing including at least one interior boss adjacent said slot, said boss having a chisel-shaped tip extending into said recess and radially aligned with said slot, the tip of said boss pinching said line cord against the other end of said husk when the cover housing is emplaced, to provide strain relief.

2. The bottom turn socket of claim 1 in which the switch includes a sleeve through which the stem extends and in which the means mounting the cover housing to the other end of the husk includes means movable axially of the sleeve to press against the cover housing.

3. The bottom turn socket of claim 2 in which the sleeve is externally threaded, and the means movable axially of the sleeve is a lock ring screwed onto said sleeve.

4. The bottom turn socket of claim 2 in which the sleeve and the opening in the crown are of matching non-circular configurations.

5. The bottom turn socket of claim 1 in which the means mounting said stem to the other end of said husk includes a two-leg bracket, the terminal end of each leg of said bracket being attached to the other end of said husk, said bracket having an opening through which the stem extends.

6. The bottom turn socket of claim 1 in which the number of interior bosses in the cover housing is two, the cover housing being provided with a slot adjacent each interior boss, the second boss pinching a second line cord.

* * * * *